United States Patent [19]

Schilling

[11] Patent Number: 5,074,485

[45] Date of Patent: Dec. 24, 1991

[54] THREAD GUIDE

[75] Inventor: Peter Schilling, Galgenen, Switzerland

[73] Assignee: SIegfried Peyer AG, Wollerau, Switzerland

[21] Appl. No.: 542,080

[22] Filed: Jun. 22, 1990

[30] Foreign Application Priority Data

Jul. 4, 1989 [CH] Switzerland ..... 02476/89

[51] Int. Cl.[5] ..... B65H 57/04

[52] U.S. Cl. ..... 242/157 R

[58] Field of Search ..... 242/157 R

[56] References Cited

U.S. PATENT DOCUMENTS

| | | | |
|---|---|---|---|
| 2,160,780 | 5/1939 | Kennedy | 242/157 R |
| 2,369,809 | 1/1945 | Spangler | 242/157 R |
| 2,373,078 | 4/1945 | Kleist | 242/157 R |
| 3,722,722 | 3/1973 | Flowers et al. | 242/157 R |
| 3,870,241 | 3/1975 | Norwood | 242/157 RX |
| 4,480,805 | 11/1984 | Sachleben et al. | 242/157 |
| 4,533,968 | 8/1985 | Yoshida et al. | 242/157 RX |

FOREIGN PATENT DOCUMENTS

| | | |
|---|---|---|
| 128589 | 3/1902 | Fed. Rep. of Germany . |
| 549797 | 4/1932 | Fed. Rep. of Germany . |
| 633717 | 8/1936 | Fed. Rep. of Germany . |
| 2543983 | 12/1976 | Fed. Rep. of Germany . |

*Primary Examiner*—Daniel P. Stodola
*Assistant Examiner*—Michael R. Mansen
*Attorney, Agent, or Firm*—Walter C. Farley

[57] ABSTRACT

A thread guide for yarn cleaners has a disk-like body (1) with a front plate (11) a rear plate (12) and a generally V-shaped cutout (2) of which radial surfaces (3, 4) serve as thread entry surfaces and of which the center (5) serves as thread-guide floor. The thread-guide floor (5) has a first hump (6) serving to restrict thread motion vertically from a central thread path (17), the right-hand thread entry surface (3) has a second hump (7) serving to limit lateral thread motion to the right of path (17) and the left-hand thread entry (4) has a third hump (8) serving as to limit lateral thread motion to the left of the path, the highest elevations (points of greatest protrusion) (13, 14, 15) of the three humps (6, 7, 8) being axially offset from each other.

16 Claims, 4 Drawing Sheets

THREAD GUIDE

The invention relates to a thread guide for use with yarn cleaners, the guide being of the type having inlet and outlet plates and a cutout for receiving the thread.

BACKGROUND OF THE INVENTION

Thread guides are used primarily in yarn cleaners. As a rule one thread guide is present ahead of and another after the detection zone of the yarn cleaner for purposes of thread guidance.

The thread guides of the state of the art usually consist of polished aluminum-ceramic plates with a V-cutout (the so-called V thread guides). They share the feature of the thread being simultaneously bounded on three different sides by surfaces present in one plane orthogonal to the direction of thread motion. Because of this simultaneous constriction at three planar points (in one radial plane), two kinds of drawbacks follow.

The first drawback is that impurities on or in the thread (particularly slubs or lumps) become stuck in the planar thread constriction. The second drawback is that the lump causes a brief jump of the thread out of the V cutout of the first thread guide and the lump continues undetected beyond the detection zone.

Considering the ever more stringent requirements presently placed on the accuracy of yarn cleaners and the presently conventional thread speeds of more than 1,000 meters/min, the above drawbacks become increasingly intolerable.

SUMMARY OF THE INVENTION

An object of the invention is to provide an improved thread guide lacking simultaneous constriction of the thread passage on several sides in a single plane and permitting the use of a single thread guide per yarn cleaner.

Briefly described, the invention comprises a thread guide for yarn cleaners having a disk-like body with a front (inlet) plate and a rear (outlet) plate and with a generally V-shaped cutout of which side surfaces serve for thread entry and the center serves as thread-guide floor. The improvement comprises means at the thread-guide floor comprising a first hump serving as a thread restriction, means at the right-hand thread entry comprising a second hump serving as a thread restriction, and means at the left-hand thread entry comprising a third hump serving as a thread restriction, each of the humps protruding toward a central thread path with the points of greatest protrusion of the three humps being axially offset from each other.

Essentially the advantages of a guide according to the invention are that only a single thread guide (following the measurement zone of the yarn cleaner) is required in lieu of several (at least two) and that even if the guided thread suffers from coarse defects there is neither jamming within the slub detection zone nor circumvention of it.

Another advantage of the preferred embodiment of the invention is that, because of three spaced humps serving as thread boundaries, an exit duct asymmetric relative to the direction of advance of the thread is produced which can be easily cleaned any time using an air nozzle mounted outside the path of the thread.

BRIEF DESCRIPTION OF THE DRAWINGS

An illustrative embodiment of the invention which at the same time elucidates the principle of operation is described below in further detail, and is shown in the drawings wherein.

DESCRIPTION OF THE PREFERRED EMBODIMENT

Figure 1:
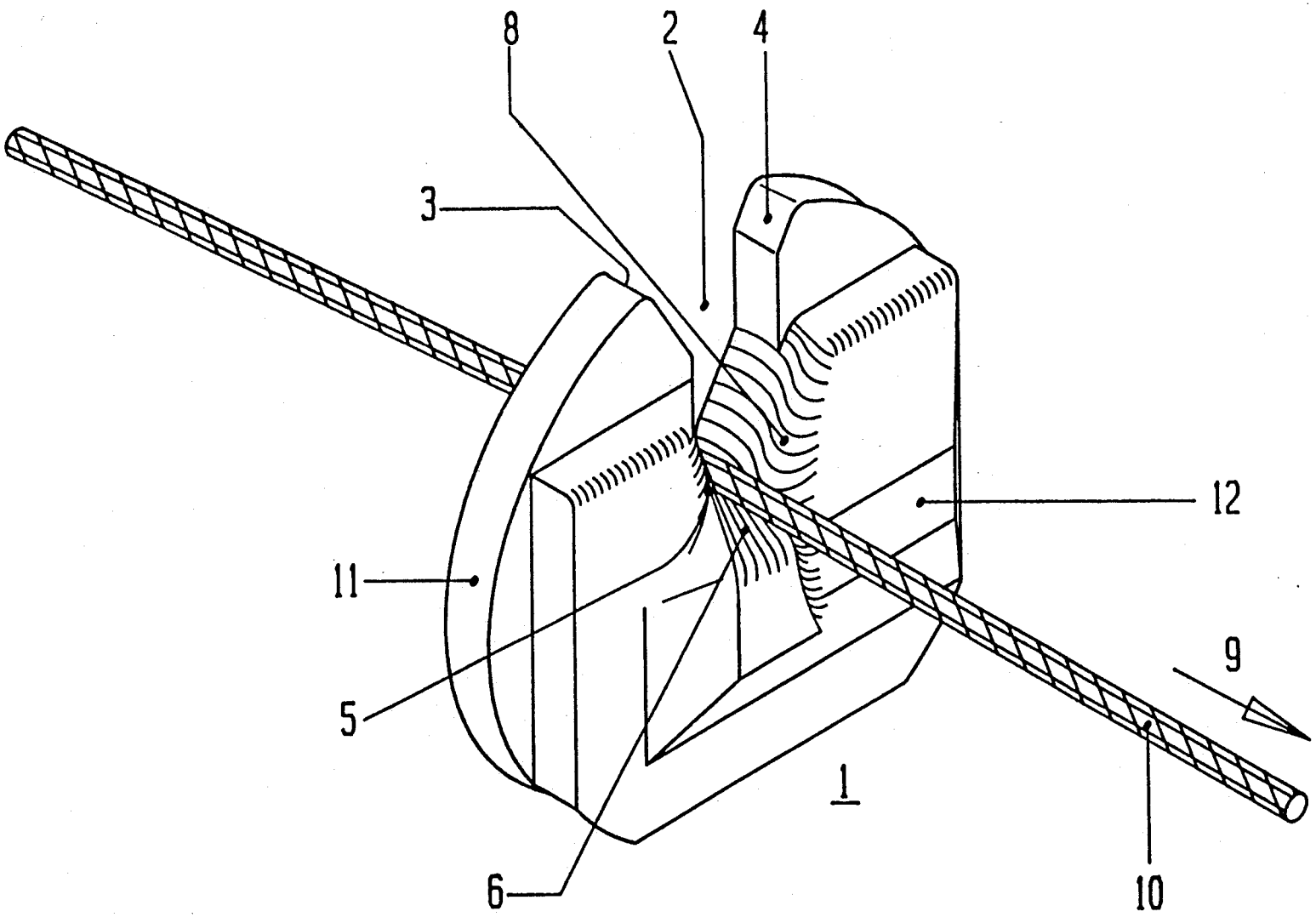
FIG. 1 is a perspective view of a thread guide in accordance with the invention as seen from the exit side.
Figure 2:
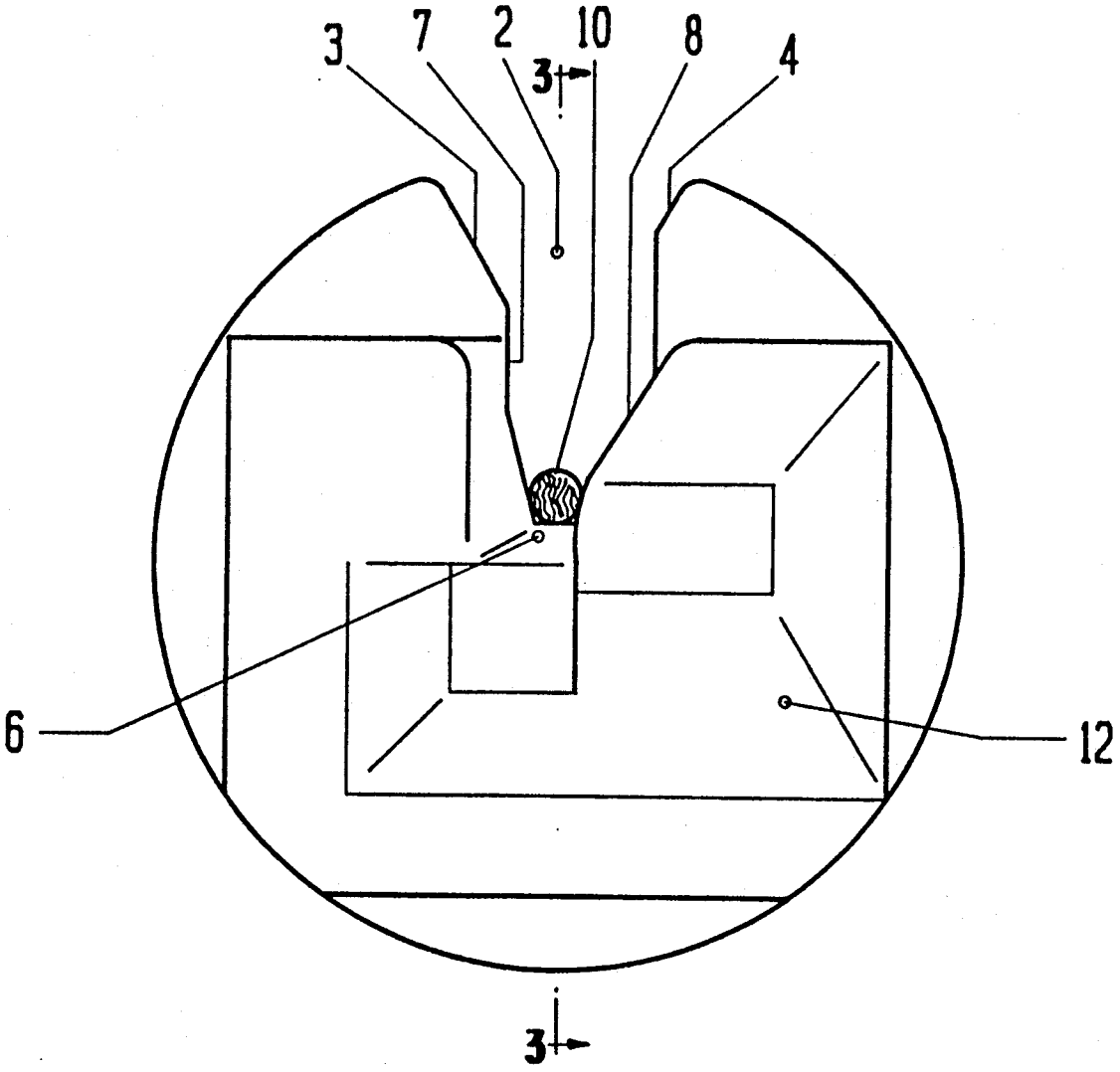
FIG. 2 is a rear (exit side) elevation of the thread guide of FIG. 1.

The thread guide shown in FIGS. 1 and 2 consists of a disk-like body 1 with a front, generally circular plate 11 at the inlet side of the guide and a rear, generally rectangular plate 12 at the outlet side. The body 1 is preferably made of an aluminum oxide ceramic and, to reduce friction, its surface parts are polished smooth. The body 1 is formed with a generally V-shaped cutout 2 which occupies a sector of about 60°, the angled surfaces 3 and 4 of this cutout serving to facilitate thread entry and its center 5 acting as the thread guide floor. Thread passes generally along a path following central axis 17.

Figure 3:
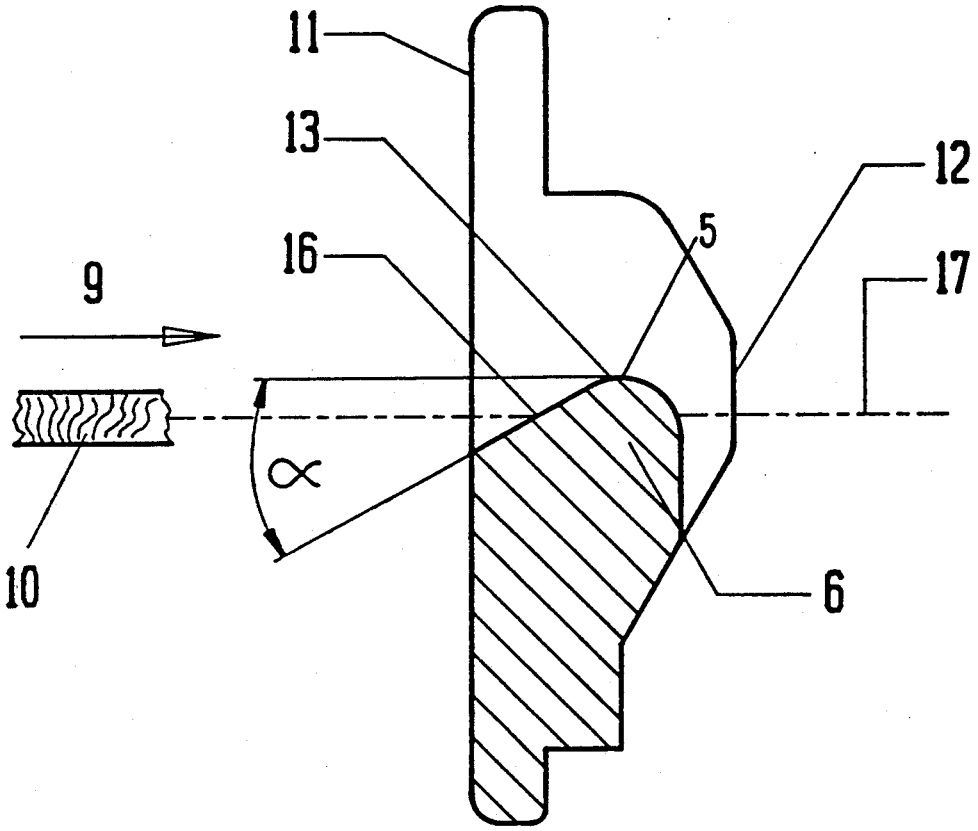
FIG. 3 is a longitudinal sectional view along line 3—3 of FIG. 2.

As shown by FIG. 3, the thread guide floor 5 comprises a first rounded guide hump 6 serving to control the position of the thread. The apex or point of greatest protrusion (highest radial elevation) 13 of this floor is axially offset relative to the inlet-side surface of front plate 11 toward the rear plate 12 of the body 1 by about 2 mm for a fine thread guide and 2.8 mm for a coarse thread guide to facilitate entry of the thread 10. For the same reason, the entry ramp 16 of protruding hump 6 facing toward the front (inlet side) plate 11 subtends an angle $\alpha$ of 29.2° relative to central axis 17 of body 1.

Figure 4:
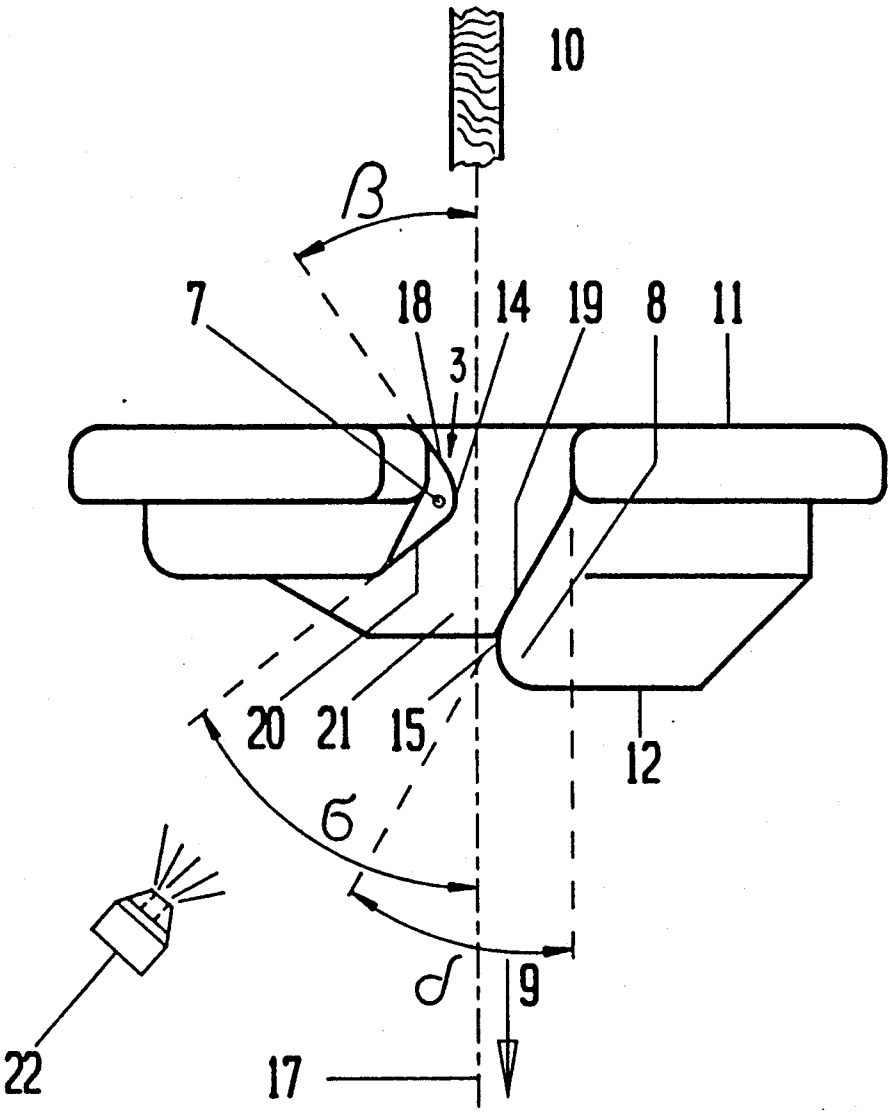
FIG. 4 is a top plan view of the thread guide perpendicular to FIG. 3.

FIG. 4 shows that the thread entry surface 3, which is on the right hand side as seen in the direction of advance 9 of the thread, assumes the shape of a second rounded guide hump 7 serving to restrict lateral movement of the thread. Its apex or location of greatest protrusion or elevation 14 is axially shifted as much as possible toward the front plate 11 of the body 1, typically 1.0 mm for fine thread and 1.5 mm for coarse thread. Again the thread entry 4, which is on the left as seen from the inlet direction of advance 9 of the thread, assumes the shape of a third rounded guide hump 8 for thread position control of which the limit of greatest protrusion 15 is axially shifted by about 2.7 mm for fine thread and 3.6 mm for coarse thread relative to the front (inlet) surface of plate 11 toward the rear plate 12 of the body 1. As a result, the largest possible axial spacing (at least 1.7 mm fine and 2.1 mm coarse) between the peaks of the two humps 7 and 8 is achieved, so that the simultaneous constriction of the thread path is avoided.

The same purpose is served by the optimal shaping of the entry and exit ramps 18, 19, 20 of the humps 7 and 8. The entry ramp 18 of the second hump 7 facing the front plate 11 forms an angle $\beta$ of 35.5° and the entry ramp 19 of the third hump 8 facing the rear plate 12 forms an angle $\delta$ of 30° relative to the central axis of the body 1.

Because the exit ramp 20 of the second hump 7 facing the rear plate 12 subtends an angle $\sigma$ of 52° relative to the central axis 17 of the body 1, an exit duct 21 (FIG. 4), oblique relative to the central axis, is achieved which therefore can be cleaned without difficulty by means of an air nozzle 22 located in the extension of the exit duct 21.

The overall thickness of the guide (in the direction of thread motion is about 3.5 mm for a guide for use with fine thread and 4.5 mm for a coarse thread guide.

What is claimed is:

1. A thread guide for yarn cleaners of the type including a disk-like body (1) with a front, inlet plate (11) and a rear, exit plate (12) and with a generally V-shaped cutout (2) of which side surfaces (3,4) serve for thread guidance and the center (5) serves as a thread-guide floor, wherein the improvement comprises means at the thread-guide floor (5) comprising a first hump (6) having an apex over which the thread passes for limiting vertical thread motion, means at the right-hand thread entry (3) comprising a second hump (7) having an apex over which the thread passes for limiting lateral thread motion, means at the left-hand thread entry (4) comprising a third hump (8) having an apex over which the thread passes for limiting lateral thread motion, each said hump protruding toward a central thread path with the apex points of greatest protrusion (13, 14, 15) of the three humps (6, 7, 8) being axially offset from each other in the direction of the thread movement.

2. A thread guide according to claim 1, wherein surfaces (13, 14, 15) of said three humps (6, 7, 8) lie in three different radial planes of said disk-like body (1).

3. A thread guide according to claim 2, in that the greatest radial protrusion (13) of the first hump (6) is offset relative to the front plate (11) toward the rear plate (12), by a distance between 1.8 and 2.8 mm.

4. A thread guide according to claim 3, wherein the greatest radial protrusion (14) of the second hump (7) is offset toward the front plate (11) of the body (1).

5. A thread guide according to claim 4, wherein the greatest radial protrusion (15) of the third hump (8) is offset relative to the front surface of the front plate (11) toward the rear plate (12) of the body (1), by a distance of between 2.5 and 3.6 mm.

6. A thread guide according to claim 4, wherein the points of greatest radial protrusion (14, 15) of the two humps (7, 8) are axially spaced apart by at least 1.7 mm.

7. A thread guide according to claim 6, wherein the entry ramp (16) of the first hump (6) facing the front plate (11) subtends an angle $\alpha$ of between 26.2° and 32.2° relative to the central axis (17) of the body (1).

8. A thread guide according to claim 7 wherein said angle $\alpha$ is between 28.2° and 30.2° relative to said central axis.

9. A thread guide according to claim 7, wherein the entry ramp (18) of the second hump (7) facing the front plate (11) subtends an angle $\beta$ of 32.5° to 38.5° relative to the central axis (17) of the body (1).

10. A thread guide according to claim 9 wherein said angle $\beta$ is between 34.5° and 36.5° relative to said central axis.

11. A thread guide according to claim 9, wherein the entry ramp (19) of the third hump (8) facing the rear plate (12) subtends an angle $\delta$ of 27° to 33° relative to the central axis (17) of the body (1).

12. A thread guide according to claim 11, wherein the exit ramp (20) of the second hump (7) facing the rear plate (12) subtends an angle $\sigma$ of 49° to 55° relative to the central axis (17) of the body (1).

13. A thread guide according to claim 11 wherein said angle $\delta$ is between 29° and 31° relative to said central axis.

14. A thread guide according to claim 10 wherein said angle $\sigma$ is between 51° and 53°.

15. A thread guide for yarn cleaners comprising a unitary, disk-like body having a front, inlet surface and a rear, outlet surface and having means defining a generally V-shaped notch for receiving and guiding thread passing longitudinally and substantially continuously therethrough in the direction from said front surface to said rear surface, said notch including a floor surface including a smoothly rounded, upwardly extending first protrusion having an apex extending transversely of said direction of thread movement;

a first side surface on one side of said notch having a smoothly rounded, laterally extending second protrusion having an apex, said apex of said second protrusion extending transversely of said direction of thread movement and being offset from said apex of said first protrusion in a direction parallel with the direction of thread movement; and a second side surface on the other side of said notch having a smoothly rounded third protrusion extending toward said first side surface and having an apex, said apex of said third protrusion extending transversely of said direction of thread movement and being offset from both said apex of said first protrusion and said apex of said second protrusion in the direction parallel with the direction of thread movement.

16. A thread guide according to claim 15 wherein said apex of said second protrusion is offset toward said rear surface from the apex of said first protrusion, and wherein said apex of said third protrusion is offset toward said rear surface from the apex of said second protrusion.

* * * * *